US011970253B1

(12) United States Patent
Sturtevant

(10) Patent No.: US 11,970,253 B1
(45) Date of Patent: Apr. 30, 2024

(54) BOAT LIFT ASSEMBLY

(71) Applicant: Great Lakes Lift, Inc., Caro, MI (US)

(72) Inventor: David John Sturtevant, Caro, MI (US)

(73) Assignee: Great Lakes Lift, Inc., Caro, MI (US)

( * ) Notice: Subject to any disclaimer, the term of this patent is extended or adjusted under 35 U.S.C. 154(b) by 0 days.

(21) Appl. No.: 18/474,595

(22) Filed: Sep. 26, 2023

(51) Int. Cl.
*B63C 3/02* (2006.01)
*B63C 3/06* (2006.01)

(52) U.S. Cl.
CPC ..... *B63C 3/06* (2013.01)

(58) Field of Classification Search
CPC ..... B63C 3/02; B63C 3/06; B63C 3/08
See application file for complete search history.

(56) References Cited

U.S. PATENT DOCUMENTS 2,852,152 A * 9/1958 Rosselle ..... B60P 3/1033 414/534
3,773,195 A * 11/1973 Honea ..... B60P 3/32 193/35 SS
6,182,597 B1 * 2/2001 Maxwell ..... B63C 3/12 114/344
8,256,366 B2 9/2012 Imel et al.
9,051,035 B2 6/2015 Imel et al.
2010/0247243 A1 * 9/2010 Imel ..... B63C 3/02 405/3
2011/0243663 A1 * 10/2011 Smith ..... B63C 3/02 405/3

FOREIGN PATENT DOCUMENTS

KR 1127624 B1 * 3/2012

* cited by examiner

*Primary Examiner* — Benjamin F Fiorello
*Assistant Examiner* — Stacy N Lawson
(74) *Attorney, Agent, or Firm* — Buckert Patent & Trademark Law Firm PC; John F. Buckert

(57) ABSTRACT

A boat lift assembly includes a first base member having a central beam portion and first and second sloped beam portions, and a second base member having a central beam portion and first and second sloped beam portions. The assembly includes a first plurality of roller tubes coupled to the first sloped beam portions of the first and second base members, and a first plurality of rollers disposed on the first plurality of roller tubes. The assembly includes a second plurality of roller tubes coupled to the central beam portions of the first and second base members, and a second plurality of rollers disposed on the second plurality of roller tubes. The assembly includes a third plurality of roller tubes coupled to the second sloped beam portions of the first and second base members, and a third plurality of rollers disposed on the third plurality of roller tubes.

16 Claims, 14 Drawing Sheets

BOAT LIFT ASSEMBLY

BACKGROUND

A boat lift for small watercraft such as kayaks and canoes utilizes an elongated plastic cradle to receive the watercraft thereon. However, a drawback with such a structure is that the elongated plastic cradle is relatively heavy and difficult to move during installation. Further, the elongated plastic cradle may degrade over time when exposed to intense sunlight.

The inventor herein has recognized a need for an improved boat lift assembly that minimizes and/or reduces the above-mentioned problems.

SUMMARY

A boat lift assembly in accordance with an exemplary embodiment is provided. The boat lift assembly includes a first base member having a central beam portion, a first sloped beam portion, and a second sloped beam portion. The central beam portion of the first base member has a first end and a second end. The first sloped beam portion of the first base member is coupled to the first end of the central beam portion of the first beam member. The second sloped beam portion of the first base member is coupled to the second end of the central beam portion of the first beam member. The boat lift assembly further includes a second base member having a central beam portion, a first sloped beam portion, and a second sloped beam portion. The central beam portion of the second base member has a first end and a second end. The first sloped beam portion of the second base member is coupled to the first end of the central beam portion of the second beam member. The second sloped beam portion of the second base member is coupled to the second end of the central beam portion of the second beam member. The boat lift assembly further includes a first plurality of roller tubes that are coupled to and between the first sloped beam portion of the first base member and the first sloped beam portion of the second base member. The boat lift assembly further includes a first plurality of rollers that are rotatably disposed on the first plurality of roller tubes. The boat lift assembly further includes a second plurality of roller tubes that are coupled to and between the central beam portion of the first base member and the central beam portion of the second base member. The boat lift assembly further includes a second plurality of rollers that are rotatably disposed on the second plurality of roller tubes. The boat lift assembly further includes a third plurality of roller tubes that are coupled to and between the second sloped beam portion of the first base member and the second sloped beam portion of the second base member. The boat lift assembly further includes a third plurality of rollers that are rotatably disposed on the third plurality of roller tubes.

DETAILED DESCRIPTION

Figure 1:
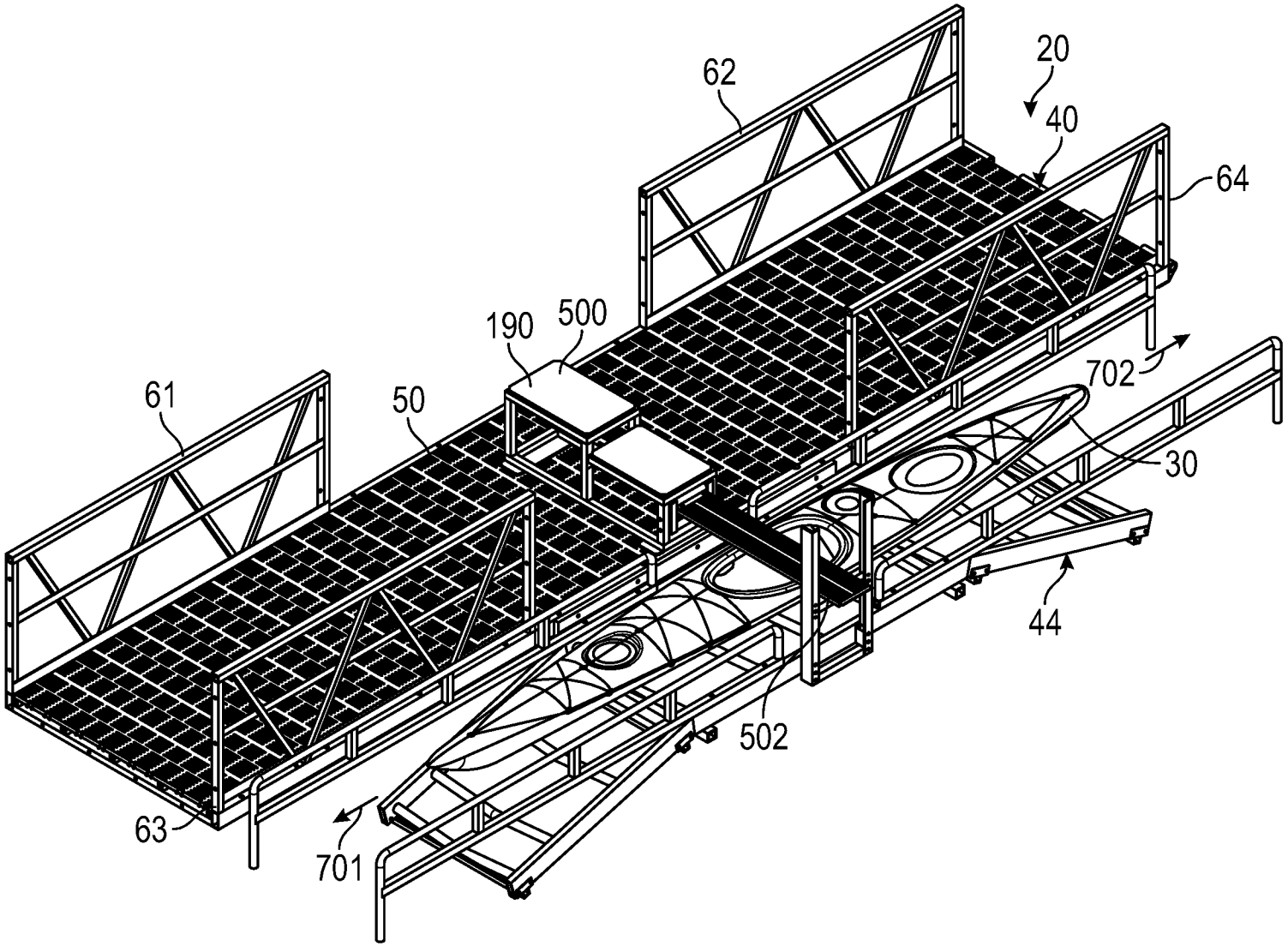
FIG. 1 is an isometric view of a docking system having a dock and a boat lift assembly in accordance with an exemplary embodiment that receives a kayak thereon.

Referring to FIGS. 1-14, a docking system 20 for receiving a small watercraft such as a kayak 30 thereon is illustrated. The docking system 20 includes a dock 40 and a boat lift assembly 44 in accordance with an exemplary embodiment.

The dock 40 includes a deck 50 and side rails 61, 62, 63, 64. The side rails 61, 62 are coupled to a first side of the dock 40 and extend upwardly from the dock 40. Also, the side rails 61, 62 are spaced apart from one another. The side rails 63, 64 are coupled to a second side of the dock 40 and extend upwardly from the dock 40. Also, the side rails 63, 64 are spaced apart from one another.

For purposes of understanding, the term "beam portion" means at least one of a tubular beam portion and a solid beam portion. Further, a tubular beam portion can have either a rectangular cross-sectional shape or a circular cross-sectional shape.

The boat lift assembly 44 is removably coupled to the dock 40 and is provided to allow a user to move the kayak 30 out of a body of water and into the body of water as desired. Further, the boat lift assembly 44 allows a disabled individual to move from the dock 40 and onto a seat member 502 for entering the kayak 30. Further, the boat lift assembly 44 allows a disabled individual to move from the kayak 30 onto the seat member 502 and then onto the dock 40.

Figure 2:
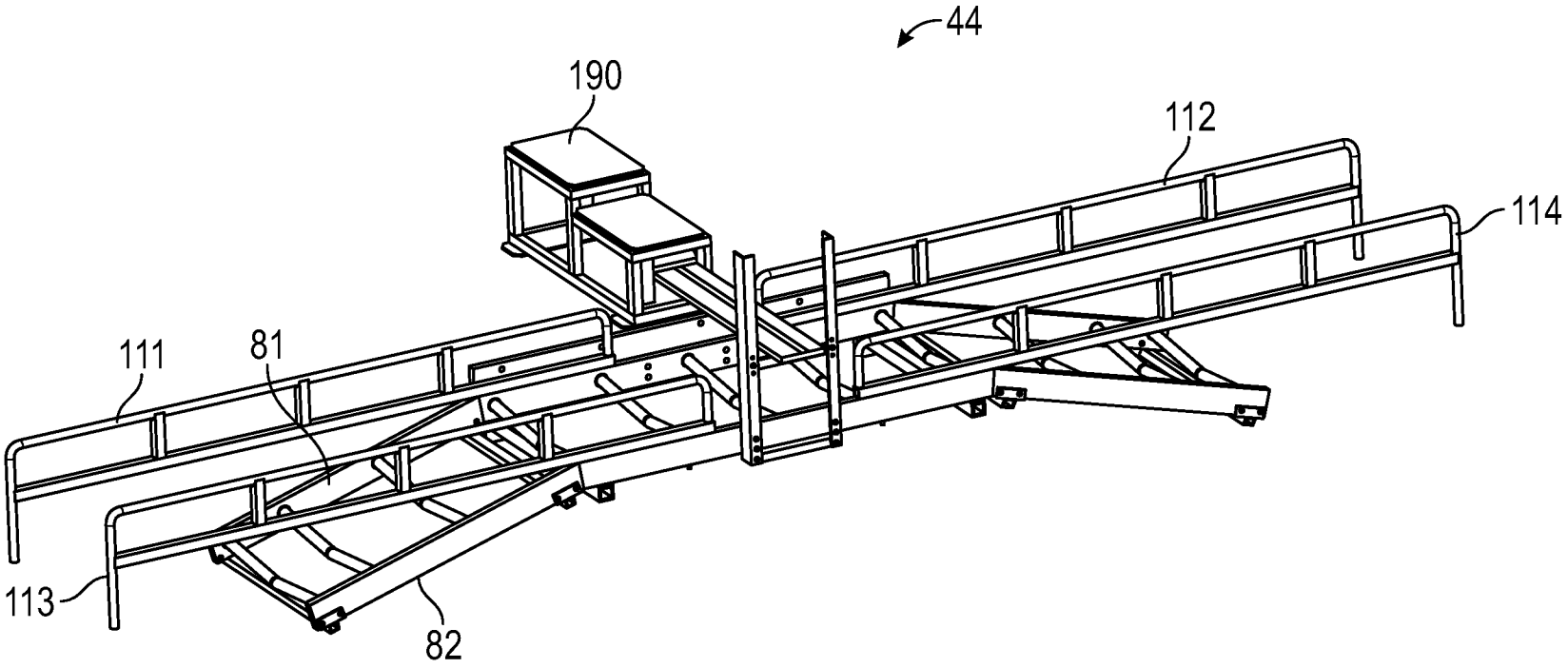
FIG. 2 is another isometric view of the boat lift assembly of FIG. 1.
Figure 3:
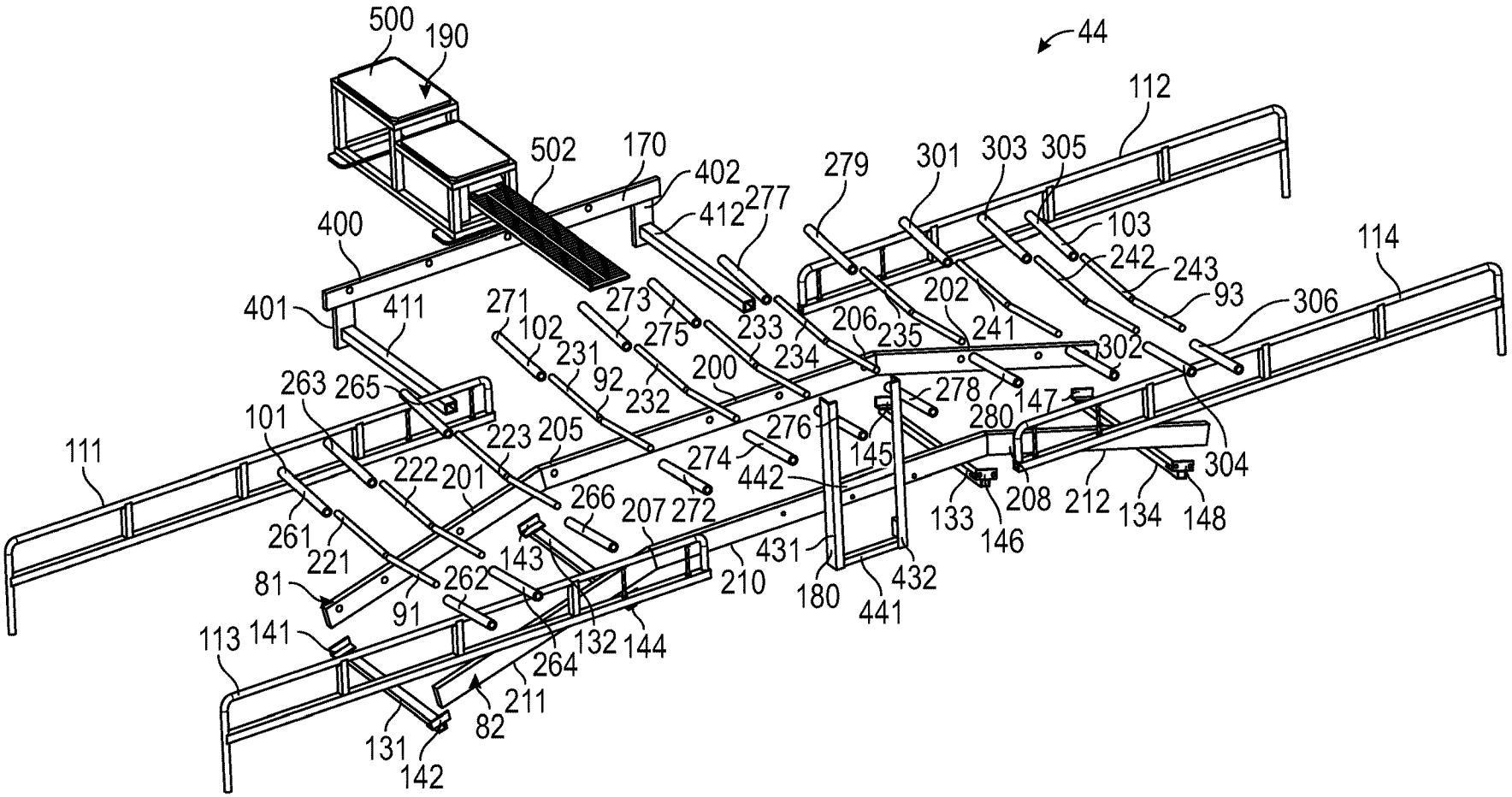
FIG. 3 is an exploded view of the boat lift assembly of FIG. 2.

Referring to FIGS. 1-3, the boat lift assembly 44 includes a first base member 81, a second base member 82, a first plurality of roller tubes 91, a second plurality of roller tubes 92, a third plurality of roller tubes 93, a first plurality of rollers 101, a second plurality of rollers 102, a third plurality of rollers 103, a first guide rail 111, a second guide rail 112, a third guide rail 113, a fourth guide rail 114, cross-members 131, 132, 133, 134, mounting brackets 141, 142, 143, 144, 145, 146, 147, 148, a dock mounting assembly 170, a support member 180, and a bench 190.

An advantage of the boat lift assembly 44 is that the assembly 44 utilizes the first base member 81 and the second base member 82 which are relatively light weight to hold most of the remaining components of the assembly, without utilizing a relatively heavy elongate plastic cradle.

Referring to FIG. 3, the first base member 81 has a central beam portion 200, a first sloped beam portion 201, and a second sloped beam portion 202. The central beam portion 200 has a first end 205 and a second end 206. The first sloped beam portion 201 is coupled to the first end 205 of the central beam portion 200. The second sloped beam portion 202 is coupled to the second end 206 of the central beam portion 200. In an exemplary embodiment, the first base member 81 is constructed of aluminum.

The second base member 82 has a central beam portion 210, a first sloped beam portion 211, and a second sloped beam portion 212. The central beam portion 210 has a first end 207 and a second end 208. The first sloped beam portion 201 is coupled to the first end 207 of the central beam portion 200. The second sloped beam portion 202 is coupled to the second end 208 of the central beam portion 200. In an exemplary embodiment, the second base member 82 is constructed of aluminum.

The first plurality of roller tubes 91 are coupled to and between the first sloped beam portion 201 of the first base member 81 and the first sloped beam portion 211 of the second base member 82. The first plurality of roller tubes 91 include roller tubes 221, 222, 223 which are spaced apart from one another. Each of the roller tubes 221, 222, 223 is v-shaped for receiving a hull of the kayak 30 thereon. In an exemplary embodiment, the roller tubes 221, 222, 223 are constructed of aluminum.

The second plurality of roller tubes 92 are coupled to and between the central beam portion 200 of the first base member 81 and the central beam portion 210 of the second base member 82. The second plurality of roller tubes 92 include roller tubes 231, 232, 233 which are spaced apart from one another. Each of the roller tubes 231, 232, 233 is v-shaped for receiving a hull of the kayak 30 thereon. In an exemplary embodiment, the roller tubes 231, 232, 233 are constructed of aluminum.

The third plurality of roller tubes 93 are coupled to and between the second sloped beam portion 202 of the first base member 81 and the second sloped beam portion 212 of the second base member 82. The third plurality of roller tubes 93 include roller tubes 241, 242, 243 which are spaced apart from one another. Each of the roller tubes 241, 242, 243 is v-shaped for receiving a hull of the kayak 30 thereon. In an exemplary embodiment, the roller tubes 241, 242, 243 are constructed of aluminum.

The first plurality of rollers 101 are rotatably disposed on the first plurality of roller tubes 91. In particular, the first plurality of rollers 101 include rollers 261, 262, 263, 264, 265, 266. Also, the rollers 261, 262 are rotatably disposed on the roller tube 221. The rollers 263, 264 are rotatably disposed on the roller tube 222. Further, the rollers 265, 266 are rotatably disposed on the roller tube 223. In an exemplary embodiment, the first plurality of rollers 101 are each constructed of a polymer that is wear resistant, corrosion resistant, ozone resistant, and impact resistant. In an exemplary embodiment, the polymer is Chlorinated Polyvinyl Chloride (aka CPVC).

The second plurality of rollers 102 are rotatably disposed on the second plurality of roller tubes 92. The second plurality of rollers 102 include rollers 271, 272, 273, 274, 275, 276, 277, 278, 279, 280. In particular, the rollers 271, 272 are rotatably disposed on the roller tube 231. Further, the rollers 273, 274 are rotatably disposed on the roller tube 232. Also, the rollers 275, 276 are rotatably disposed on the roller tube 233. Further, the rollers 277, 278 are rotatably disposed on the roller tube 234. Also, the rollers 279, 280 are rotatably disposed on the roller tube 235. In an exemplary embodiment, the second plurality of rollers 102 are each constructed of a polymer that is wear resistant, corrosion resistant, ozone resistant, and impact resistant. In an exemplary embodiment, the polymer is Chlorinated Polyvinyl Chloride (aka CPVC).

The third plurality of rollers 103 are rotatably disposed on the third plurality of roller tubes 93. The third plurality of rollers 103 include rollers 301, 302, 303, 304, 305, 306. In particular, the rollers 301, 302 are rotatably disposed on the roller tube 241. The rollers 303, 304 are rotatably disposed on the roller tube 242. Further, the rollers 305, 306 are rotatably disposed on the roller tube 243. In an exemplary embodiment, the third plurality of rollers 103 are each constructed of a polymer that is wear resistant, corrosion resistant, ozone resistant, and impact resistant. In an exemplary embodiment, the polymer is Chlorinated Polyvinyl Chloride (aka CPVC).

Figure 4:
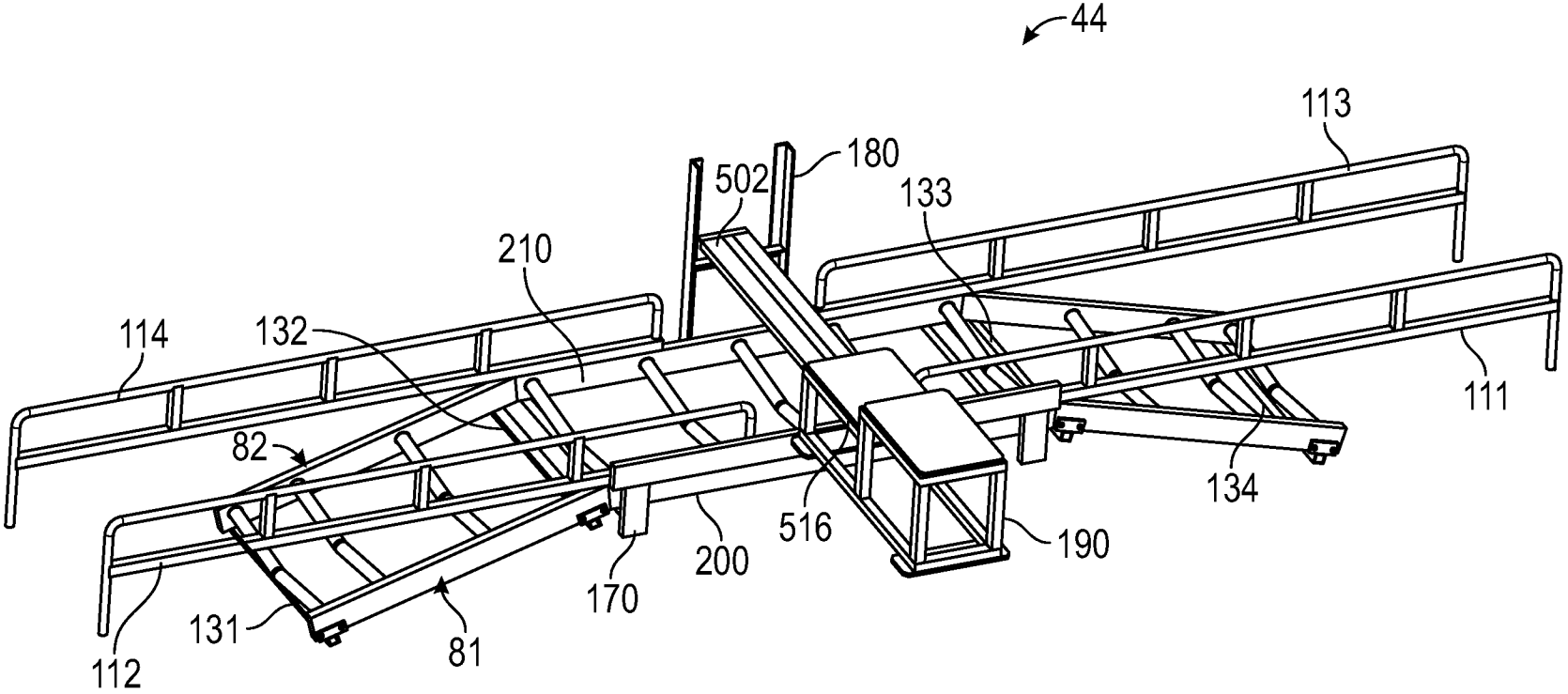
FIG. 4 is another isometric view of the boat lift assembly of FIG. 2.

Referring to FIGS. 3 and 4, the first guide rail 111 is coupled to the central beam portion 200 of the first base member 81 and extends past the first sloped beam portion 201 of the first base member 81. In an exemplary embodiment, the first guide rail 111 is constructed of aluminum.

The second guide rail 112 is coupled to the central beam portion 200 of the first base member 81 and extends past the second sloped beam portion 202 of the first base member 81. In an exemplary embodiment, the second guide rail 112 is constructed of aluminum.

The third guide rail 113 is coupled to the central beam portion 210 of the second base member 82 and extends past the first sloped beam portion 211 of the second base member 82. In an exemplary embodiment, the third guide rail 113 is constructed of aluminum.

The fourth guide rail 114 is coupled to the central beam portion 210 of the second base member 82 and extends past the second sloped beam portion 212 of the second base member 82. In an exemplary embodiment, the fourth guide rail 114 is constructed of aluminum.

The cross-member 131 is coupled to and between the first sloped beam portion 201 of the first base member 81 and the first sloped beam portion 211 of the second base member 82, utilizing the mounting brackets 141, 142, respectively. In an exemplary embodiment, the cross-member 131 is constructed of aluminum.

The cross-member 132 is coupled to and between the first sloped beam portion 201 of the first base member 81 and the first sloped beam portion 211 of the second base member 82, utilizing the mounting brackets 143, 144, respectively. In an exemplary embodiment, the cross-member 132 is constructed of aluminum.

The cross-member 133 is coupled to and between the second sloped beam portion 202 of the first base member 81 and the second sloped beam portion 212 of the second base member 82, utilizing the mounting brackets 145, 146, respectively. In an exemplary embodiment, the cross-member 133 is constructed of aluminum.

The cross-member 134 is coupled to and between the second sloped beam portion 202 of the first base member 81 and the second sloped beam portion 212 of the second base member 82, utilizing the mounting brackets 147, 148, respectively. In an exemplary embodiment, the cross-member 134 is constructed of aluminum.

The dock mounting assembly 170 is removably coupled to the dock 40 and is provided to support the first and second base members 81, 82 thereon. The dock mounting assembly 170 includes a horizontal beam 400, a first vertical beam 401, a second vertical beam 402, a cross-member 411, and a second cross-member 412. The first and second vertical beams 401, 402 are coupled to the horizontal beam 400 and extend downwardly from the horizontal beam 400. Further the first and second vertical beams 401, 402 are spaced apart from one another. The first and second cross-members 411, 412 are coupled to the first and second vertical beams 401, 402, respectively, and extend in a first direction. The horizontal beam 400 is coupled to the central beam portion 200 of the first base member 81. Further, the horizontal beam 400 is coupled to the dock 40. In an exemplary embodiment, the horizontal beam 400, the first vertical beam 401, the second vertical beam 402, the cross-member 411, and the second cross-member 412 are constructed of aluminum.

During installation, the horizontal beam 400 is coupled to the dock 40, and the central beam portion 200 of the first base member 81 is disposed on the first and second cross-members 411, 412 of the dock mounting assembly 170. Further, the central beam portion 210 of the second base member 82 is disposed on the first and second cross-members 411, 412 of the dock mounting assembly 170, and the first and second base members 81, 82 extend parallel to one another.

The seat support member 180 is provided to support the seat member 502 when the seat member 502 has a first (lowered) operational position (shown in FIG. 1). The seat support member 180 includes a first vertical wall 431, a second vertical wall 432, a first horizontal wall 441, and a second horizontal wall 442. The first and second horizontal walls 441, 442 are coupled to and between the first and second vertical walls 431, 432. The first and second vertical walls 431, 432 are coupled to the central beam portion 210 of the second base member 82. The first horizontal wall 441 supports the seat member 502 when the seat member 502 is at the first operational position. In an exemplary embodiment, the first vertical wall 431, the second vertical wall 432, the first horizontal wall 441, and the second horizontal wall 442 are constructed of aluminum.

Referring to FIGS. 1 and 12-14, the bench 190 is provided to allow a user to enter the kayak 30 and to exit the kayak 30. The bench 190 includes a bench frame 500 and seat member 502 rotatably coupled to the bench frame 500.

Figure 5:
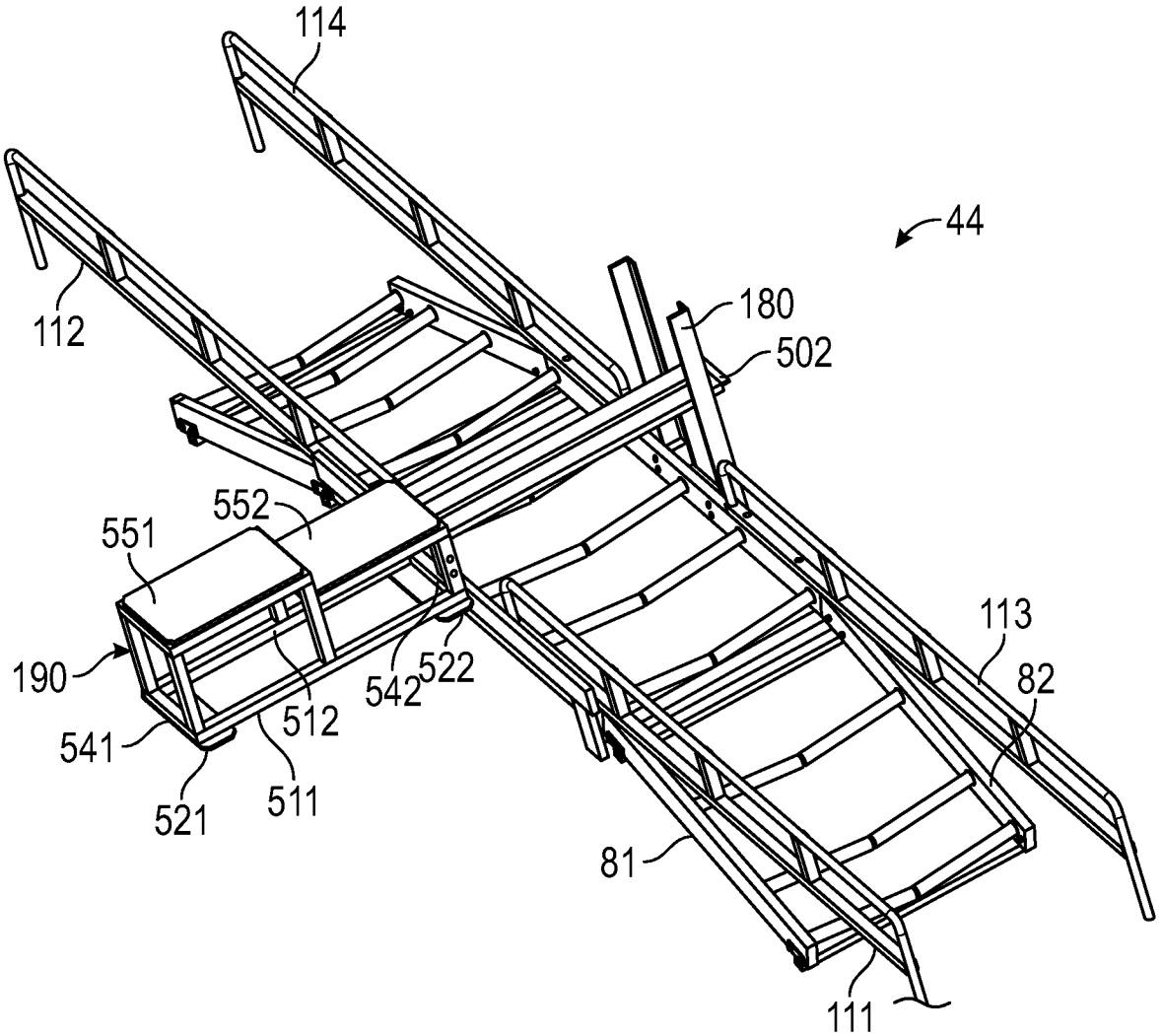
FIG. 5 is another isometric view of the boat lift assembly of FIG. 2.
Figure 6:
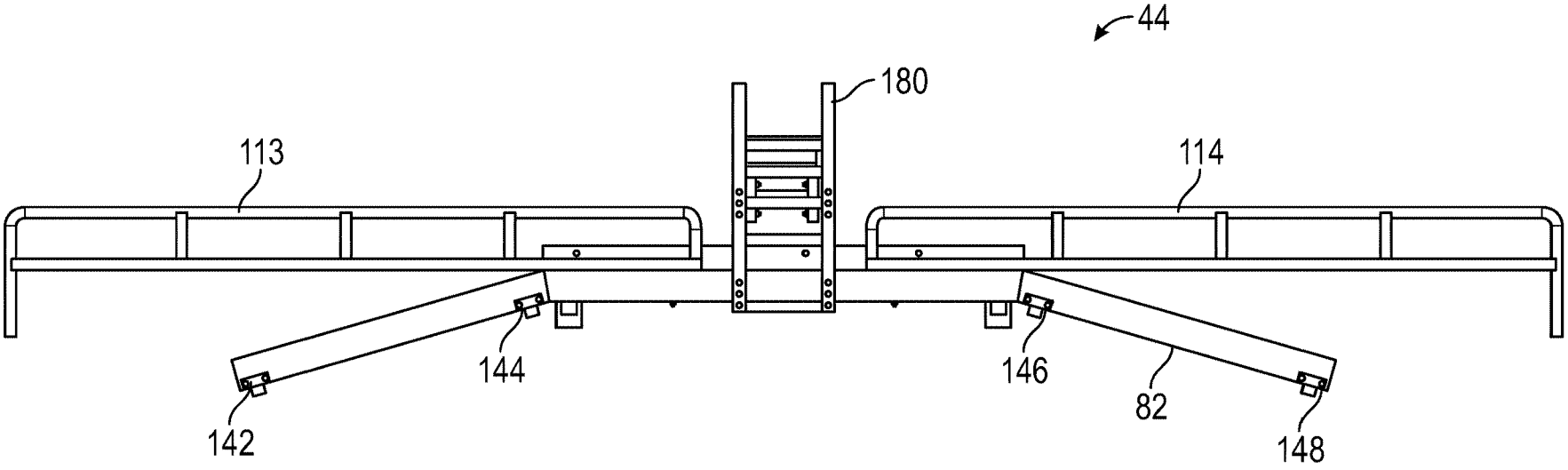
FIG. 6 is a first side view of the boat lift assembly of FIG. 2.
Figure 7:
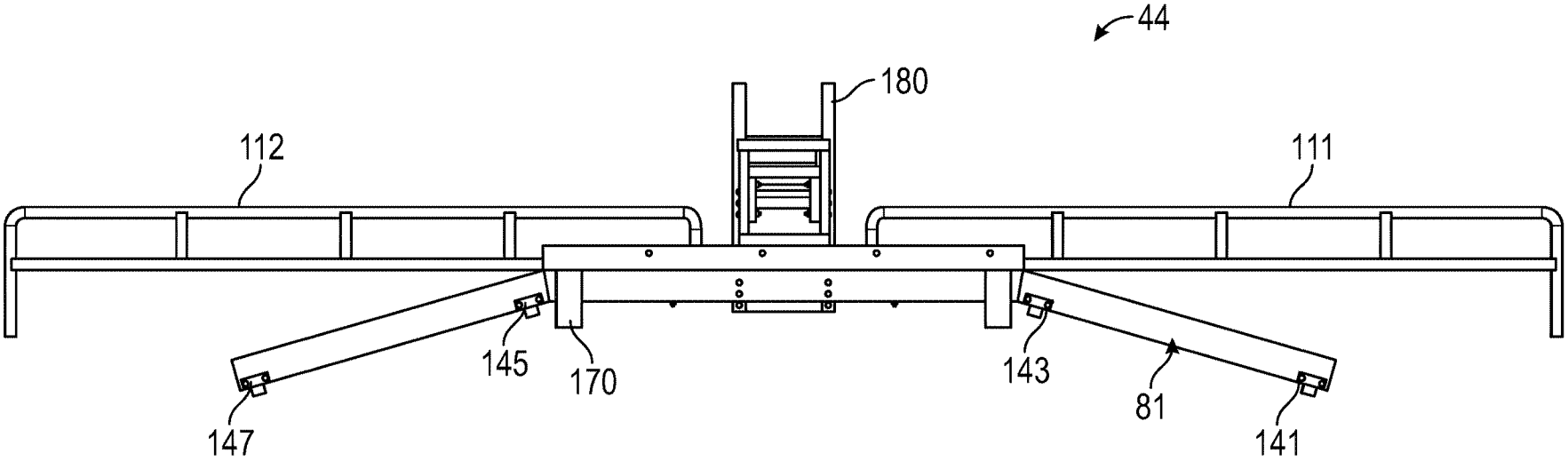
FIG. 7 is a second side view of the boat lift assembly of FIG. 2.
Figure 8:
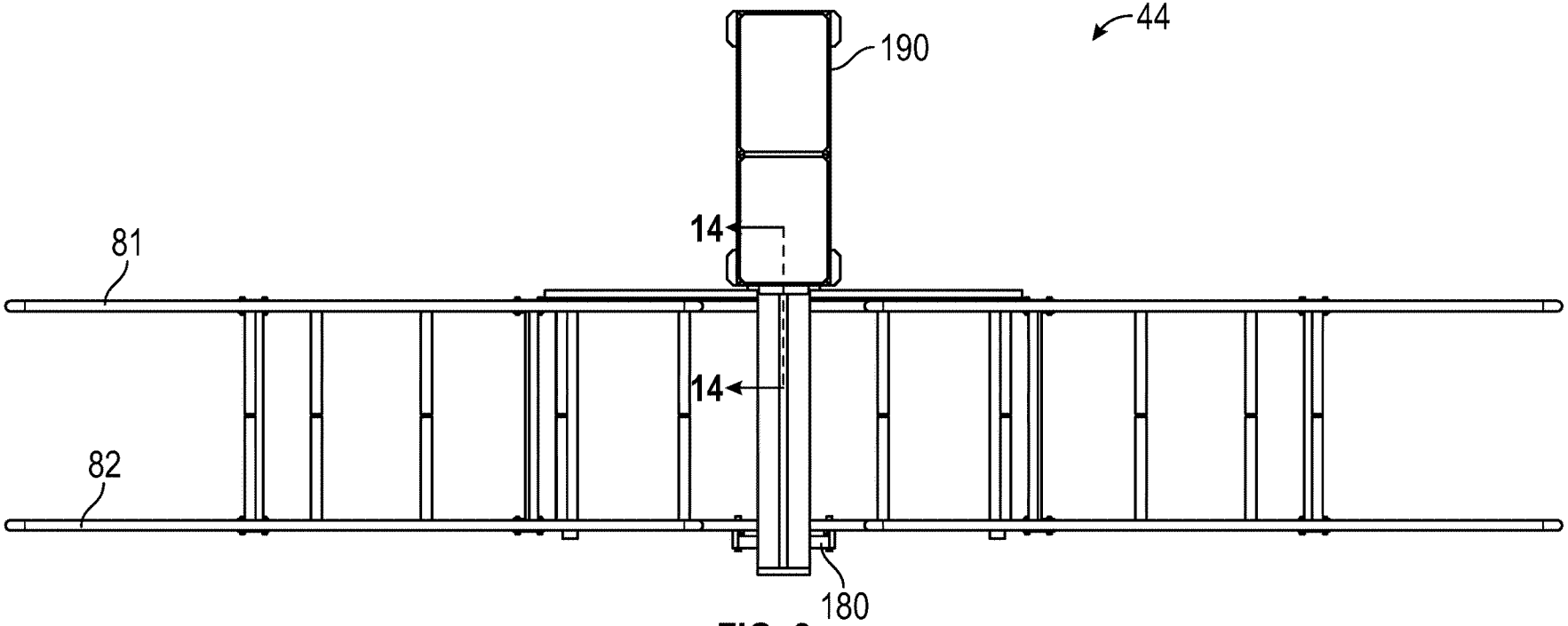
FIG. 8 is a top view of the boat lift assembly of FIG. 2.
Figure 9:
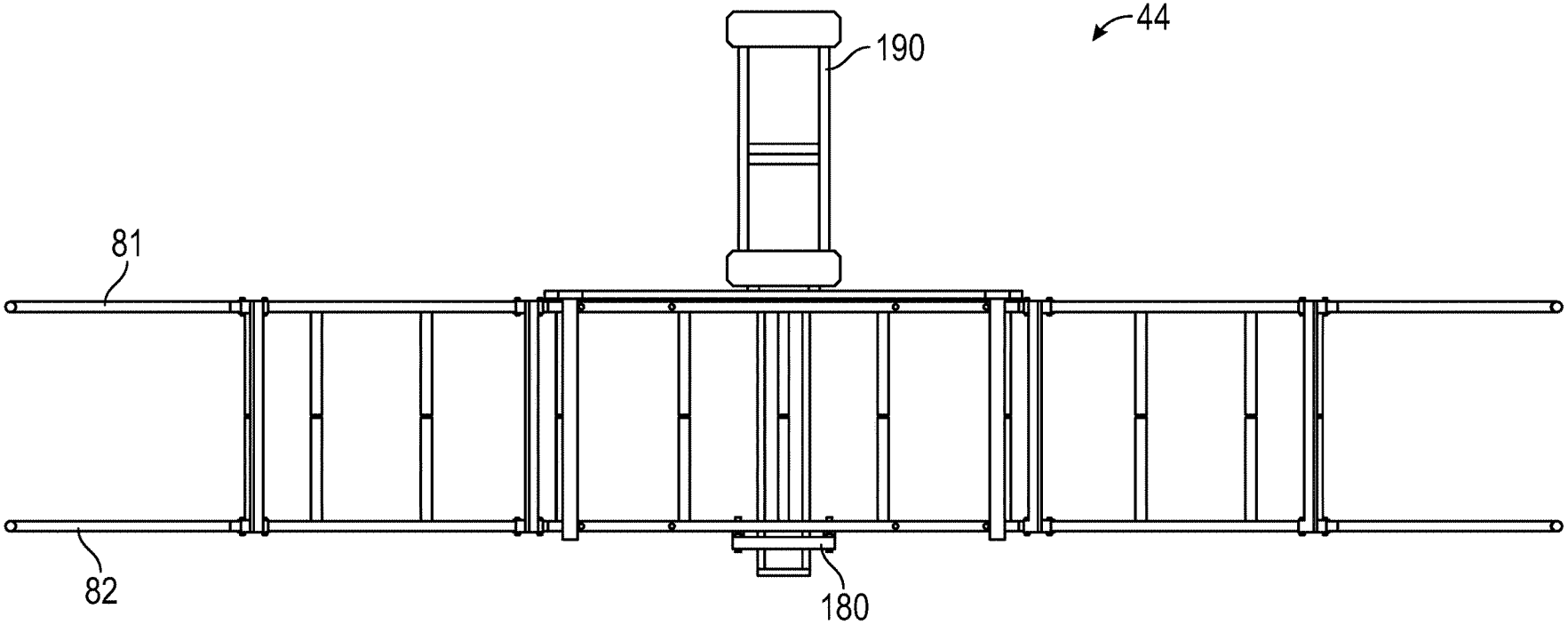
FIG. 9 is a bottom view of the boat lift assembly of FIG. 2.
Figure 10:
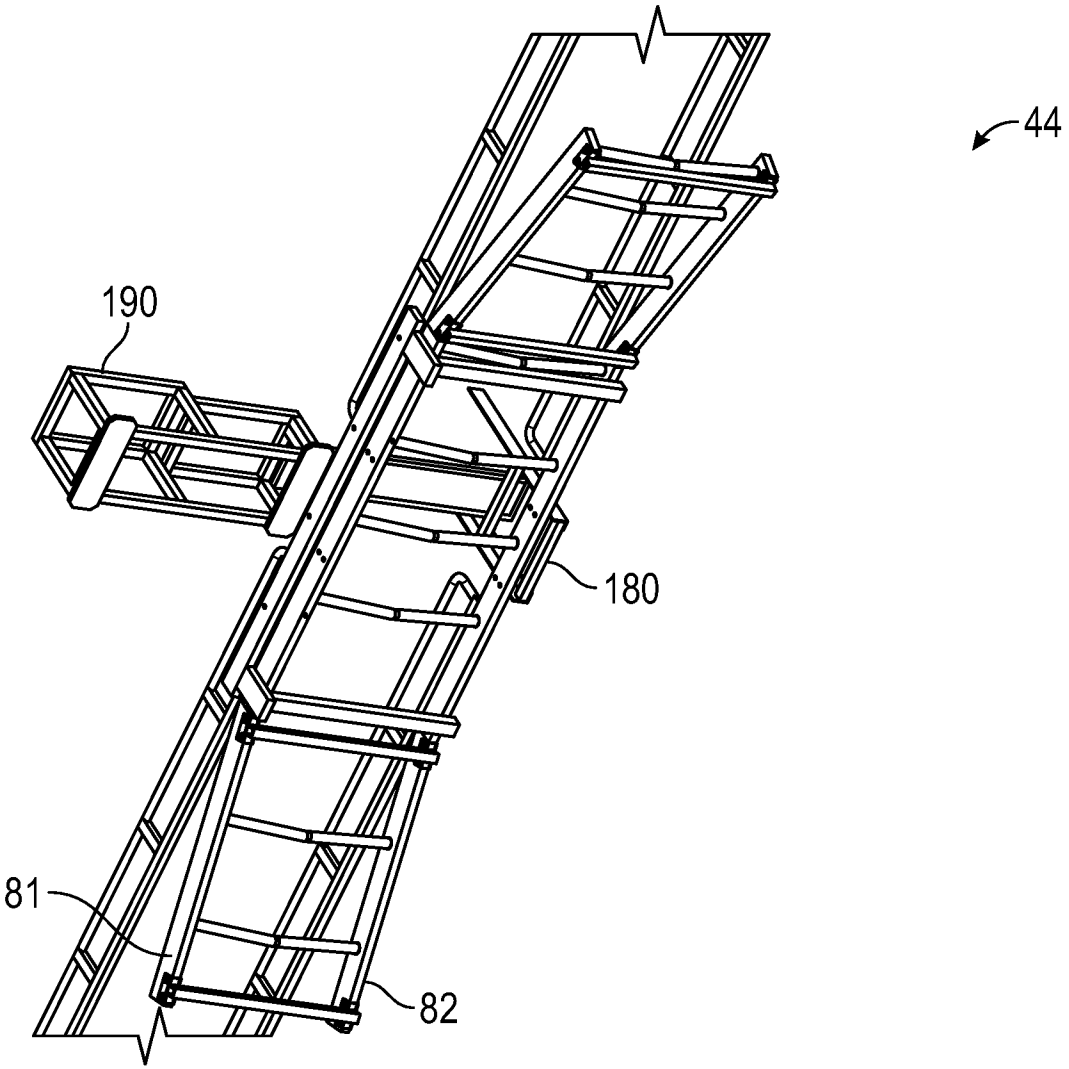
FIG. 10 is an isometric view of a portion the boat lift assembly of FIG. 2.
Figure 11:
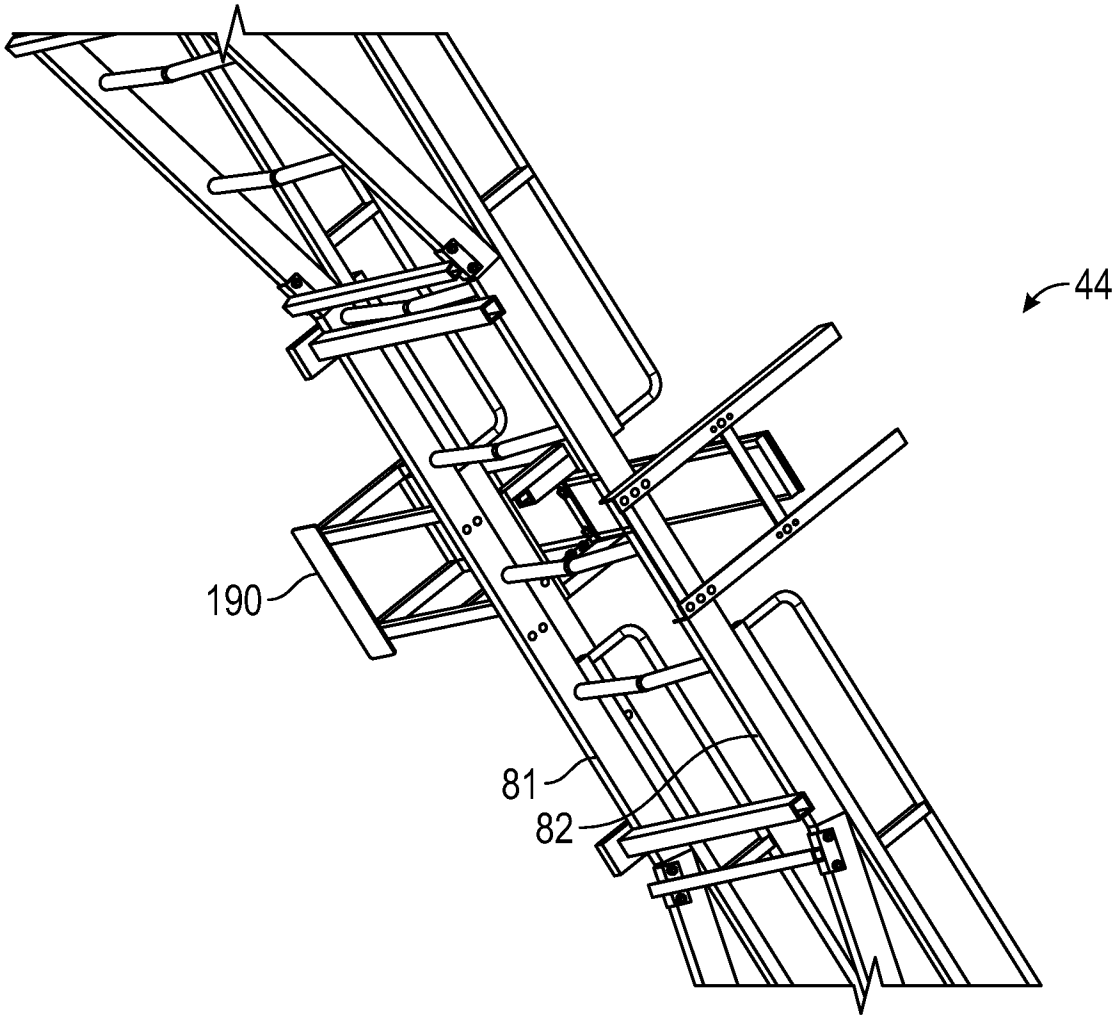
FIG. 11 is another isometric view of a portion the boat lift assembly of FIG. 2.
Figure 12:
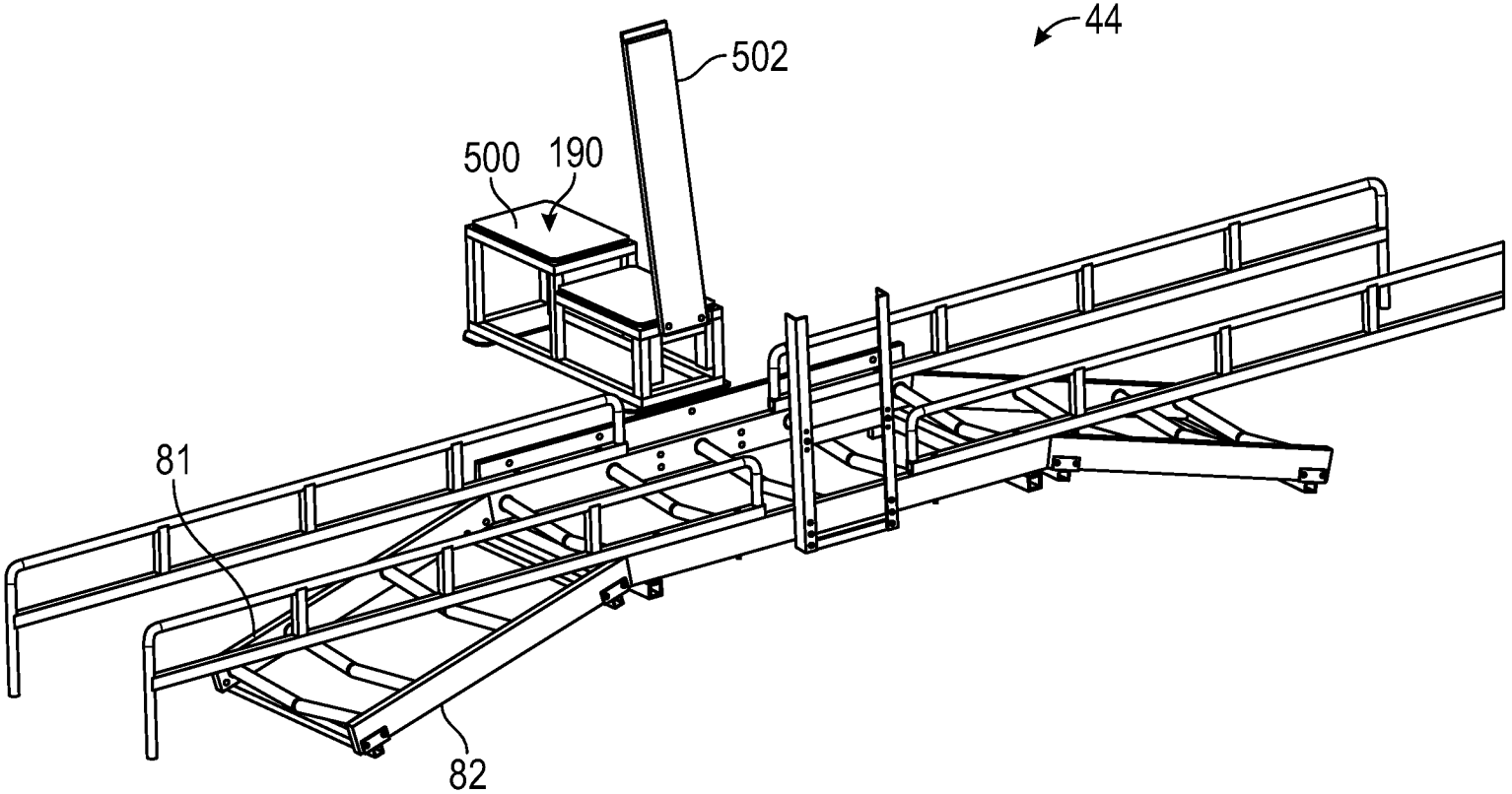
FIG. 12 is an isometric view of the boat lift assembly of FIG. 2 having a seat member in a raised operational position.
Figure 13:
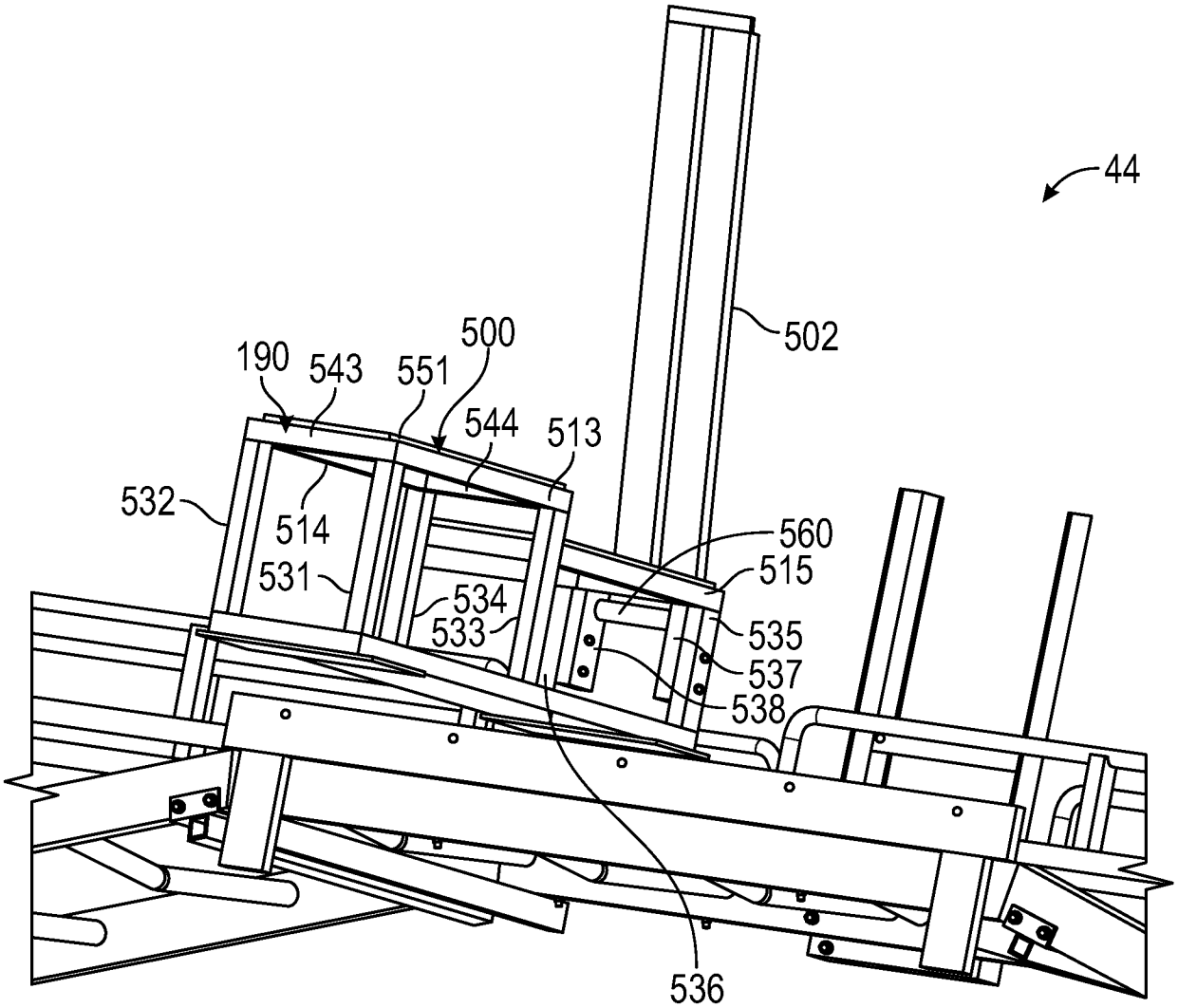
FIG. 13 is another isometric view of the boat lift assembly of FIG. 12 having the seat member in the raised operational position.
Figure 14:
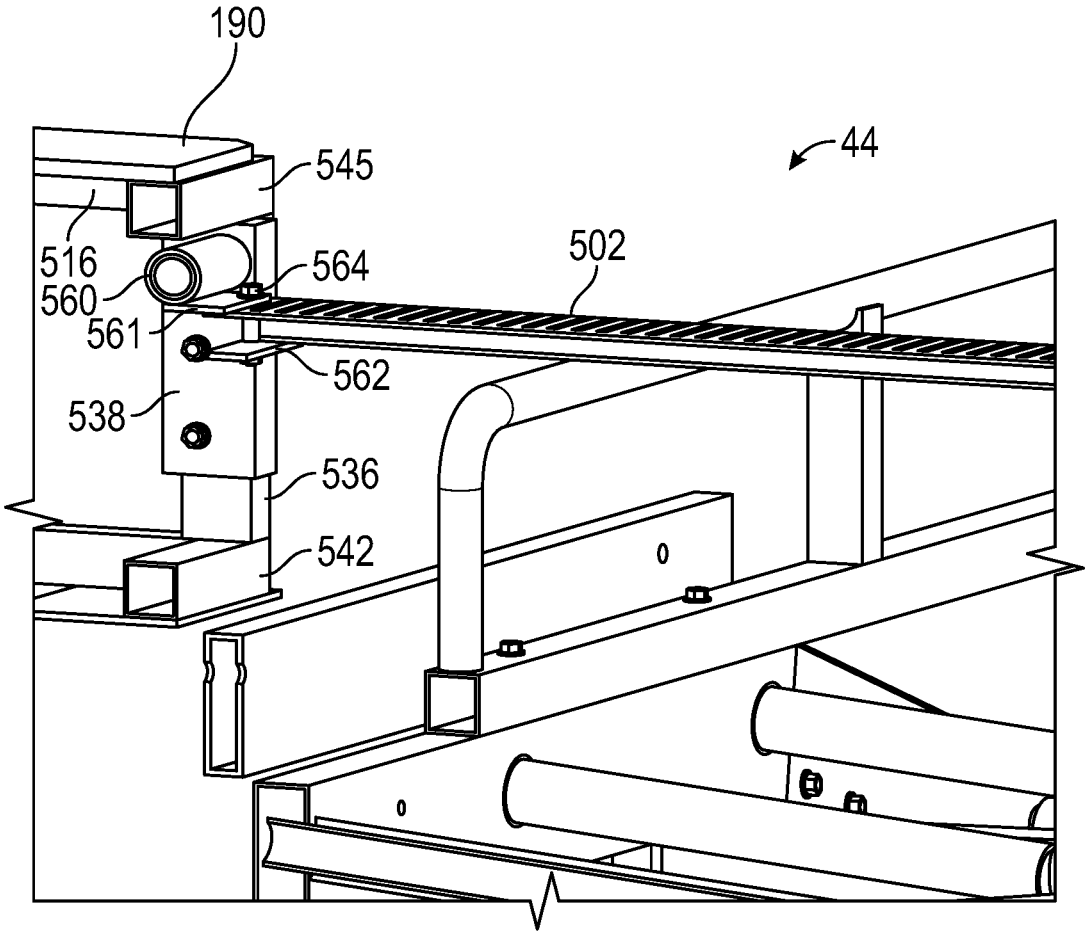
FIG. 14 is a cross-sectional view of a portion of the boat lift assembly of FIG. 2 taken along lines 8-8 in FIG. 8.

Referring to FIGS. 5, 13 and 14, the bench frame 500 includes first, second, third, fourth, fifth, sixth longitudinal members 511, 512, 513, 514, 515, 516, first and second base plates 521, 522, first, second, third, fourth, fifth, sixth, seventh, eighth vertical members 531, 532, 533, 534, 535, 536, 537, 538, first, second, third, fourth, fifth, sixth cross-members 541, 542, 543, 544, 545, a top plate 551, a top plate 552, a rotatable tube 560, an attachment plate 561, an attachment plate 562, and a bolt 564.

The first and second longitudinal members 511, 512 extend substantially parallel to one another and are disposed on the first and second base plates 521, 522.

The first cross-member 541 is coupled to and between the first and second longitudinal members 511, 512 proximate to a first end of the first longitudinal member 511 and a first end of the second longitudinal member 512, respectively. The second cross-member 542 is coupled to and between the first and second longitudinal members 511, 512 proximate to a second end of the first longitudinal member 511 and a second end of the second longitudinal member 512, respectively.

The first and third vertical members 531, 533 are coupled to and extend upwardly from the first longitudinal member 511 proximate to a first end and an intermediate portion, respectively, of the first longitudinal member 511. The second and fourth vertical members 532, 534 are coupled to an extend upwardly from the second longitudinal member 512 proximate to a first end and an intermediate portion, respectively, of the second longitudinal member 512.

The third longitudinal member 513 is coupled to and between the first vertical member 531 and the third vertical member 533.

The fourth vertical member 514 is coupled to and between the second vertical member 532 and the fourth vertical member 534.

The third cross-member 543 is coupled to and between the first and second vertical members 531, 532. The fourth cross-member 544 is coupled to and between the third and fourth vertical members 533, 534.

The top plate 551 is coupled to and supported by the third longitudinal member 513, the fourth longitudinal member 514, the third cross-member 543, and the fourth cross-member 544.

The fifth vertical member 535 is coupled to and extends upwardly from the first longitudinal member 511 proximate to a second end thereof. The sixth vertical member 536 is coupled to and extends upwardly from the second longitudinal member 512 proximate to a second end thereof. The seventh vertical member 537 is coupled to the fifth vertical member 535 and further receives a first end of a rotatable tube 560 therein. The eighth vertical member 538 is coupled to the sixth vertical member 536 and further receives a second end of the rotatable tube 560 therein.

The fifth longitudinal member 515 coupled to and disposed between the third vertical member 533 and the fifth vertical member 535. The sixth longitudinal member 516 is coupled to and disposed between the fourth vertical member 534 and the sixth vertical member 536.

The fifth cross-member 545 is coupled to and between the fifth and sixth vertical members 535, 536.

The top plate 552 is coupled to and supported by the fifth longitudinal member 515, the sixth longitudinal member 516, and the fifth cross-member 545.

The rotatable tube 560 is coupled to an attachment plate 561. An end portion of the seat member 502 is coupled to a between the attachment plate 561 in the attachment plate 562 utilizing a bolt 564. The rotatable tube 560 is rotatable relative to the seventh vertical member 537 and the eighth vertical member 538.

During operation, the seat member 502 has a first operational position (lowered operational position) shown in FIG. 1 which allows a user to enter the kayak 30 and to exit the kayak 30. The seat member 502 has a second operational position (e.g., raised operational position) shown in FIGS. 12 and 13, which allows the user and the kayak 30 to slide the kayak 30 to fully enter or pass through the boat lift assembly 44 in a first direction 701 or in a second direction 702.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A boat lift assembly, comprising:

a first aluminum base member having a central beam portion, a first sloped beam portion, and a second sloped beam portion being longitudinally aligned with one another and having an equal lateral thickness therein; the central beam portion of the first aluminum base member having a first end and a second end; the first sloped beam portion of the first aluminum base member being coupled to the first end of the central beam portion of the first aluminum base member and being tilted downwardly with respect to the central beam portion of the first aluminum base member; the second sloped beam portion of the first aluminum base member being coupled to the second end of the central beam portion of the first aluminum base member and being tilted downwardly with respect to the central beam portion of the first aluminum base member;

a second aluminum base member having a central beam portion, a first sloped beam portion, and a second sloped beam portion being longitudinally aligned with one another and having an equal lateral thickness therein; the second aluminum base member extending parallel to and spaced apart from the first aluminum base member, the central beam portion of the second aluminum base member having a first end and a second end; the first sloped beam portion of the second aluminum base member being coupled to the first end of the central beam portion of the second aluminum base member and being tilted downwardly with respect to the central beam portion of the second aluminum base member; the second sloped beam portion of the second aluminum base member being coupled to the second end of the central beam portion of the second aluminum base member and being tilted downwardly with respect to the central beam portion of the second aluminum base member;

a first v-shaped roller tube being coupled to and between the first sloped beam portion of the first aluminum base member and the first sloped beam portion of the second aluminum base member;

first and second rollers being rotatably disposed on the first v-shaped roller tube such that the first v-shaped roller tube extends through the first and second rollers;

a second v-shaped roller tube being coupled to and between the central beam portion of the first aluminum base member and the central beam portion of the second aluminum base member;

third and fourth rollers being rotatably disposed on the second v-shaped roller tube such that the second v-shaped roller tube extends through the third and fourth rollers;

a third v-shaped roller tube being coupled to and between the second sloped beam portion of the first aluminum base member and the second sloped beam portion of the second aluminum base member; and fifth and sixth rollers being rotatably disposed on the third v-shaped roller tube such that the third v-shaped roller tube extends through the fifth and sixth rollers.

2. The boat lift assembly of claim 1, further comprising:

a first guide rail being coupled to the central beam portion of the first aluminum base member and extending past the first sloped beam portion of the first aluminum base member; and a second guide rail being coupled to the central beam portion of the first aluminum base member and extending past the second sloped beam portion of the first aluminum base member.

3. The boat lift assembly of claim 2, further comprising:

a third guide rail being coupled to the central beam portion of the second aluminum base member and extending past the first sloped beam portion of the second aluminum base member; and a fourth guide rail being coupled to the central beam portion of the second aluminum base member and extending past the second sloped beam portion of the second aluminum base member.

4. The boat lift assembly of claim 1, further comprising:

a dock mounting assembly having a horizontal beam, first and second vertical beams, and first and second cross-members; the first and second vertical beams being coupled to the horizontal beam and extending downwardly from the horizontal beam; the first and second cross-members being coupled to the first and second vertical beams, respectively, and extending in a first direction; the horizontal beam being coupled to the central beam portion of the first aluminum base member;

the central beam portion of the first aluminum base member being disposed on the first and second cross-members; and the central beam portion of the second aluminum base member being disposed on the first and second cross-members.

5. The boat lift assembly of claim 1, further comprising:

a bench having a bench frame and a seat member rotatably coupled to the bench frame; and a seat support member having first and second vertical walls and first and second horizontal walls, the first and second horizontal walls being coupled to and between the first and second vertical walls; the first and second vertical walls being coupled to the central beam portion of the second aluminum base member; the first horizontal wall supporting the seat member when the seat member is at a first operational position.

6. The boat lift assembly of claim 1, wherein:

the first v-shaped roller tube having a first roller tube portion and a second roller tube portion coupled together;

the first roller tube portion extending through the first roller, the first roller being rotatable relative to the first roller tube portion; and the second roller tube portion extending through the second roller, the second roller being rotatable relative to the second roller tube portion.

7. The boat lift assembly of claim 6, wherein:

the first roller tube portion of the first v-shaped roller tube being coupled to the first sloped beam portion of the first aluminum base member; and the second roller tube portion of the first v-shaped roller tube being coupled to the first sloped beam portion of the second aluminum base member.

8. The boat lift assembly of claim 1, wherein:

the central beam portion of the first aluminum base member being a tubular central beam portion;

the first sloped beam portion of the first aluminum base member being a first tubular sloped beam portion; and the second sloped beam portion of the first aluminum base member being a second tubular sloped beam portion.

9. A boat lift assembly, comprising:

a first base member having a central tubular beam portion, a first sloped tubular beam portion, and a second sloped tubular beam portion being longitudinally aligned with one another; the central tubular beam portion of the first base member having a first end and a second end; the first sloped tubular beam portion of the first base member being coupled to the first end of the central tubular beam portion of the first base member and being tilted downwardly with respect to the central tubular beam portion of the first base member; the second sloped tubular beam portion of the first base member being coupled to the second end of the central tubular beam portion of the first base member and being tilted downwardly with respect to the central tubular beam portion of the first base member;

a second base member having a central tubular beam portion, a first sloped tubular beam portion, and a second sloped tubular beam portion being longitudinally aligned with one another; the second base member extending parallel to the first base member, the central tubular beam portion of the second base member having a first end and a second end; the first sloped tubular beam portion of the second base member being coupled to the first end of the central tubular beam portion of the second base member and being tilted downwardly with respect to the central tubular beam portion of the second base member; the second sloped tubular beam portion of the second base member being coupled to the second end of the central tubular beam portion of the second base member and being tilted downwardly with respect to the central tubular beam portion of the second base member;

a first v-shaped roller tube being coupled to and between the first sloped tubular beam portion of the first base member and the first sloped tubular beam portion of the second base member;

first and second rollers being rotatably disposed on the first v-shaped roller tube;

a second v-shaped roller tube being coupled to and between the central tubular beam portion of the first base member and the central tubular beam portion of the second base member;

third and fourth rollers being rotatably disposed on the second v-shaped roller tube;

a third v-shaped roller tube being coupled to and between the second sloped tubular beam portion of the first base member and the second sloped tubular beam portion of the second base member; and fifth and sixth rollers being rotatably disposed on the third v-shaped roller tube.

10. The boat lift assembly of claim 9, wherein:

the first v-shaped roller tube having a first roller tube portion and a second roller tube portion coupled together;

the first roller tube portion extending through the first roller, the first roller being rotatable relative to the first roller tube portion; and the second roller tube portion extending through the second roller, the second roller being rotatable relative to the second roller tube portion.

11. The boat lift assembly of claim 10, wherein:

the first roller tube portion of the first v-shaped roller tube being coupled to the first sloped tubular beam portion of the first base member; and the second roller tube portion of the first v-shaped roller tube being coupled to the first sloped tubular beam portion of the second base member.

12. A boat lift assembly, comprising:

a first base member having a central beam portion, a first sloped beam portion, and a second sloped beam portion that define a flat vertical outer surface that extends an entire longitudinal length of the first base member; the central beam portion of the first base member being coupled to and between the first sloped beam portion and the second sloped beam portion of the first base member; the first sloped beam portion of the first base member being tilted downwardly with respect to the central beam portion of the first base member; the second sloped beam portion of the first base member being tilted downwardly with respect to the central beam portion of the first base member;

a second base member having a central beam portion, a first sloped beam portion, and a second sloped beam portion that define a flat vertical outer surface that extends an entire longitudinal length of the second base member; the flat vertical outer surface of the second base member extending parallel to and facing the flat vertical outer surface of the first base member, the central beam portion of the second base member being coupled to and between the first sloped beam portion and the second sloped beam portion of the second base member; the first sloped beam portion of the second base member being tilted downwardly with respect to the central beam portion of the second base member; the second sloped beam portion of the second base member being tilted downwardly with respect to the central beam portion of the second base member;

a first v-shaped roller tube being coupled to and between a portion of the flat vertical outer surface defined by the first sloped beam portion of the first base member and a portion of the flat vertical outer surface defined by the first sloped beam portion of the second base member;

first and second rollers being rotatably disposed on the first v-shaped roller tube;

a second v-shaped roller tube being coupled to and between a portion of the flat vertical outer surface defined by the central beam portion of the first base member and a portion of the flat vertical outer surface defined by the central beam portion of the second base member;

third and fourth rollers being rotatably disposed on the second v-shaped roller tube;

a third v-shaped roller tube being coupled to and between a portion of the flat vertical outer surface defined by the second sloped beam portion of the first base member and a portion of the flat vertical outer surface defined by the second sloped beam portion of the second base member; and fifth and sixth rollers being rotatably disposed on the third v-shaped roller tube.

13. The boat lift assembly of claim 12, wherein:

the first v-shaped roller tube having a first roller tube portion and a second roller tube portion coupled together;

the first roller tube portion extending through the first roller, the first roller being rotatable relative to the first roller tube portion; and the second roller tube portion extending through the second roller, the second roller being rotatable relative to the second roller tube portion.

14. The boat lift assembly of claim 13, wherein:

the first roller tube portion of the first v-shaped roller tube being coupled to the first sloped beam portion of the first base member; and the second roller tube portion of the first v-shaped roller tube being coupled to the first sloped beam portion of the second base member.

15. The boat lift assembly of claim 12, wherein:

the central beam portion, the first sloped beam portion, and the second sloped beam portion of the first base member being longitudinally aligned with one another;

the central beam portion, the first sloped beam portion, and the second sloped beam portion of the second base member being longitudinally aligned with one another; and the second base member extending parallel to the first base member.

16. The boat lift assembly of claim 12, wherein:

the first base member is a first aluminum base member; and the second base member is a second aluminum base member.

* * * * *